US007063224B2

(12) United States Patent
Clarke et al.

(10) Patent No.: US 7,063,224 B2
(45) **Date of Patent: *Jun. 20, 2006**

(54) LID WITH DRINK OPENING

(75) Inventors: Brian Norman Clarke, Huntingdon (GB); Peter Robert Wills, Huntingdon (GB); Nigel Frank Taylor, Huntingdon (GB)

(73) Assignee: Solo Cup Operating Corporation, Highland Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/080,579

(22) Filed: Mar. 15, 2005

(65) Prior Publication Data

US 2005/0155969 A1 Jul. 21, 2005

Related U.S. Application Data

(63) Continuation of application No. 10/165,190, filed on Jun. 7, 2002, now Pat. No. 6,874,649.

(30) Foreign Application Priority Data

Dec. 20, 2001 (GB) ..... 1030619.0

(51) Int. Cl.
*A47G 19/22* (2006.01)
*B65D 43/24* (2006.01)
*B65D 51/20* (2006.01)

(52) U.S. Cl. ..... 220/254.3; 220/268; 220/712; 220/713; 220/718; 220/832

(58) Field of Classification Search ..... 220/254.3, 220/268, 712, 713, 718, 832
See application file for complete search history.

(56) References Cited

U.S. PATENT DOCUMENTS

| | | | |
|---|---|---|---|
| 1,237,228 | A | 8/1917 | Westover |
| 1,725,393 | A | 8/1929 | Cone |
| 1,752,720 | A | 4/1930 | Bergelson |
| 1,896,976 | A | 2/1933 | Schifferdecker |
| 2,121,554 | A | 6/1938 | Thorn |
| 2,495,806 | A | 1/1950 | Block |
| 2,554,710 | A | 5/1951 | Leccese |
| 3,031,111 | A | 4/1962 | Stull |

(Continued)

FOREIGN PATENT DOCUMENTS

| | | |
|---|---|---|
| CH | 393 955 | 11/1965 |

(Continued)

OTHER PUBLICATIONS

Color photograph of Dixie Spout lid obtained through market research, Apr. 2000.

(Continued)

*Primary Examiner*—Nathan J. Newhouse
*Assistant Examiner*—Niki M. Eloshway
(74) *Attorney, Agent, or Firm*—Wallenstein Wagner & Rockey, Ltd.

(57) ABSTRACT

The present invention provides a lid for a beverage cup. The lid has a generally annular side wall, a rib depending from the side wall, and a top wall extending radially inward from the side wall. The lid further includes a central region positioned radially inward of the top wall. The central region has a well with a notched portion. The lid also includes a projection extending from a portion of the side wall. A living hinge formed by a line of weakness at the base of the projection permits the projection to pivot between an open position and a closed position. The central region has a shoulder portion that engages the tip of the projection to secure the projection in the open position.

21 Claims, 3 Drawing Sheets

U.S. PATENT DOCUMENTS 3,083,861 A 4/1963 Amberg et al.
3,188,036 A 6/1965 Sprung
3,193,130 A 7/1965 Miller
3,262,612 A 7/1966 Tabor
3,326,401 A 6/1967 De Long
3,327,905 A 6/1967 Gould
3,459,324 A 8/1969 Miller
3,690,514 A 9/1972 Wilson
3,805,991 A 4/1974 Cheladze et al.
3,874,580 A 4/1975 Weatherhead, III
3,994,411 A 11/1976 Elfelt et al.
4,091,956 A 5/1978 Vecchio
4,138,033 A 2/1979 Payne et al.
4,141,461 A 2/1979 LaChance
4,183,443 A 1/1980 DeParales et al.
4,188,457 A 2/1980 Throp
4,203,527 A 5/1980 LaChance, Sr.
4,253,582 A * 3/1981 Shields ..... 220/269
4,331,255 A 5/1982 Fournier
4,333,583 A 6/1982 Montemarano
4,345,695 A 8/1982 Galloway et al.
4,347,946 A 9/1982 Nichols
4,350,260 A 9/1982 Prueher
4,361,249 A 11/1982 Tuneski et al.
4,420,092 A 12/1983 Finkelstein
4,441,624 A 4/1984 Sokolowski
4,449,640 A 5/1984 Finkelstein
4,460,103 A * 7/1984 Rama et al. ..... 220/254.3
4,478,346 A 10/1984 Spong
4,503,992 A 3/1985 Sitko et al.
4,557,398 A 12/1985 Hambleton et al.
4,570,817 A 2/1986 Hambleton et al.
4,579,245 A 4/1986 Narushko
4,589,569 A 5/1986 Clements
4,598,837 A 7/1986 Kreiseder et al.
4,615,459 A 10/1986 Clements
4,619,372 A 10/1986 McFarland
4,629,088 A * 12/1986 Durgin ..... 220/254.3
4,657,139 A 4/1987 Hanifl
4,703,873 A 11/1987 Geren
4,705,197 A 11/1987 Gordon et al.
4,718,570 A 1/1988 Diener
4,738,373 A * 4/1988 DeParales ..... 220/254.3
4,741,450 A * 5/1988 Braude ..... 220/712
4,747,511 A 5/1988 Dutt et al.
4,753,365 A 6/1988 Seppala
4,770,325 A 9/1988 Gordon et al.
4,782,975 A 11/1988 Coy
4,790,444 A 12/1988 Terzi
4,792,054 A 12/1988 Weidman
4,796,774 A 1/1989 Nabinger
4,863,051 A 9/1989 Eibner et al.
4,869,389 A 9/1989 Cerrone, Jr.
4,874,103 A 10/1989 Quisenberry et al.
4,898,295 A 2/1990 Kim
4,899,902 A 2/1990 DeMars
4,915,250 A 4/1990 Hayes, Jr.
4,930,654 A 6/1990 Thibeault et al.
4,932,555 A 6/1990 La Barge
4,938,379 A 7/1990 Kellner
4,949,865 A 8/1990 Turner
4,953,743 A 9/1990 Dart et al.
4,966,300 A 10/1990 Coonradt
5,012,061 A 4/1991 Lesser
5,090,584 A * 2/1992 Roberts et al. ..... 220/712
5,111,961 A 5/1992 Van Melle
5,148,936 A 9/1992 DeGrow
5,167,338 A 12/1992 Kick
5,180,073 A 1/1993 Fay et al.
5,183,172 A 2/1993 Boller
5,193,704 A 3/1993 Kick
5,197,624 A 3/1993 Doddaro
5,205,430 A 4/1993 Valyi
5,294,014 A 3/1994 Wyatt et al.
D346,718 S 5/1994 Timmermans
5,395,006 A 3/1995 Verma
5,398,843 A 3/1995 Warden et al.
5,415,312 A 5/1995 Mueller
5,421,472 A 6/1995 Beckertgis
5,449,085 A 9/1995 Brun, Jr.
5,485,938 A 1/1996 Boersma
5,490,609 A 2/1996 Lane et al.
5,495,941 A 3/1996 Leonard
5,497,920 A 3/1996 Moeller et al.
D368,624 S 4/1996 Forrer
5,503,289 A 4/1996 Fox
5,503,662 A 4/1996 Berger
5,540,350 A 7/1996 Lansky
5,588,561 A 12/1996 Ness
5,613,619 A * 3/1997 Van Melle ..... 220/712
5,699,927 A * 12/1997 Lane et al. ..... 220/254.3
5,706,972 A 1/1998 Sousa
5,718,353 A 2/1998 Kanfer et al.
5,727,707 A 3/1998 Wickland et al.
5,766,660 A 6/1998 Lee et al.
5,775,205 A 7/1998 Melton
5,839,601 A * 11/1998 Van Melle ..... 220/712
D402,556 S 12/1998 Frye
5,866,184 A 2/1999 Gorlich et al.
5,873,298 A 2/1999 Chang
5,911,331 A * 6/1999 Boller ..... 220/254.3
5,913,964 A 6/1999 Melton
5,947,319 A 9/1999 Sinski
5,947,323 A 9/1999 Freek et al.
5,954,241 A 9/1999 Huang
5,979,689 A 11/1999 Lansky
5,984,127 A 11/1999 Fenton
5,996,837 A 12/1999 Freek et al.
6,003,711 A 12/1999 Bilewitz
6,010,029 A 1/2000 Wang
6,089,397 A * 7/2000 Van Melle ..... 220/270
6,095,033 A 8/2000 Melton
6,176,384 B1 1/2001 Voloshin
D437,223 S 2/2001 Coy et al.
6,199,711 B1 3/2001 Lansky
6,216,904 B1 4/2001 Cagan
6,220,470 B1 4/2001 McHenry et al.
6,305,571 B1 10/2001 Chu
6,374,726 B1 4/2002 Melton
6,419,105 B1 7/2002 Bruce et al.
6,578,726 B1 6/2003 Schaefer
6,612,456 B1 * 9/2003 Hundley et al. ..... 220/254.3
D480,968 S 10/2003 Atkins et al.
6,644,409 B1 11/2003 Clarke
6,874,649 B1 * 4/2005 Clarke et al. ..... 220/254.3
2002/0027139 A1 3/2002 O'Neill
2003/0089713 A1 5/2003 Belt et al.
2003/0089714 A1 5/2003 Dart et al.
2003/0141302 A1 7/2003 Ryan et al.

FOREIGN PATENT DOCUMENTS

DE 18 16 709 A1 2/1970
DE 295 02 654 U1 8/1995
EP 0 160 372 A 11/1985
EP 0 383 442 A1 8/1990
GB 1 576 126 A 10/1980
GB 1 600 917 10/1981
GB 2 091 232 A 7/1982
GB 2 182 027 A 5/1987
JP 07-309379 11/1995
JP 10-129706 A 5/1998
JP 2000-159254 6/2000
WO WO 99 47429 9/1999

WO WO 00 51908 9/2000

OTHER PUBLICATIONS

Color photograph of Dart Tear Tab lid obtained through market research, Apr. 2000.
Color photograph of Imperial Bondware Tear Tab lid obtained through market research, Apr. 2000.
Color photograph of Dixie "Traveler" lid obtained through market research, Apr. 2000.
Color photograph of Chinet Brown "Traveler" lid obtained through market research, Apr. 2000.
Color photograph of Imperial Bondware "Travler" lid obtained through market research, Apr. 2000.
Color photograph of Maui Push-Thru lid obtained through market research, Apr. 2000.
Color photograph of Solo Traveler Black lid obtained through market research, Apr. 2000.
Color photograph of Imperial Bondware Push-Thru lid obtained through market research, Apr. 2000.
Color photograph of Amhill/One Cup lid obtained through market research, Apr. 2000.
Color photograph of HotJo Ceramic Mug/Lid obtained through market research, Apr. 2000.
Color Photograph of metallic Starbucks Cup/Lid obtained through market research, Apr. 2000.
Color photograph of plastic Starbucks Cup/Lid obtained through market research, Apr. 2000.
Color photograph of White Hen Cup/Lid obtained through market research, Apr. 2000.
Color photograph of Super America Cup/Lid obtained through market research, Apr. 2000.
Color photograph of white Starbucks Cup/Lid obtained through market research, Apr. 2000.
Color photograph of Dunkin Donuts Cup/Lid obtained through market research, Apr. 2000.
*Seven (7) color photograph showing different views of Whirley Thermo Mug/Lid obtained in Feb. 2003.

* cited by examiner

LID WITH DRINK OPENING

CROSS-REFERENCE TO RELATED APPLICATIONS

This application is a continuation of U.S. application Ser. No. 10/165,190 now U.S. Pat. No. 6,874,649, filed Jun. 7, 2002, which is incorporated herein by reference and made a part hereof, and upon which a claim of priority is based. Parent U.S. application Ser. No. 10/165,190 is a U.S. national filing claiming priority from pending United Kingdom Application No. 0130619.0 filed Dec. 20, 2001.

TECHNICAL FIELD

This invention relates to lids for containers, such as "take-away" hot and cold beverage cups.

BACKGROUND OF THE INVENTION

Conventionally, various types of lids are used for disposable containers, e.g., disposable plastics or paper cups hot or cold beverages, such as are used by "fast food" and "take-away" outlets. Such lids are intended to provide a degree of retention of the beverage in the container when that container is accidentally knocked, shaken or tilted, whilst also allowing the beverage to be consumed as required. Such containers and lids, being single-use disposable items, must be capable of being produced at a low cost.

SUMMARY OF THE INVENTION

A typical disposable lid for such a beverage container is formed from think plastics sheet material, for example by vacuum forming, and comprises a top panel with a downwardly depending peripheral rim. The plastics material of the lid is resiliently flexible so that the lid can be fitted over the open top of a suitably sized beverage container so that the rim of the lid grips the rim of the open end of the container, whereby the beverage is retained within the container.

In a known development of the basic plastic lid described above, a lid is provided with an aperture positioned at a point near to the rim of the lid. The aperture is chosen so that it is sufficiently enlarged to allow a user to drink from the container without having to remove the lid itself, but sufficiently small to reduce the risk of spillage of the beverage if the container is tilted or shaken. In addition, the aperture may be initially blocked by a press out tab or flap which can be pushed into the container when initial discharge of the beverage is required. However, such press-out tabs or flaps can be difficult to press out without a suitable instrument, which the purchaser of a beverage in a container fitted with the lid may not have hand.

It is therefore an object of the present invention to provide a lid which can be fitted to a container to prevent spillage of the contents while allowing an opening of restricted size to be produced readily in the lid for access to the contents of the container.

According to the present invention there is provided a lid for a beverage cup, the lid being moulded from resiliently flexible sheet material and comprising a projecting portion having a base connected with the remainder of the lid along a boundary formed in part by a living hinge and in the remaining part by a line of weakness such that by applying pressure to one side of said projection, the base of said projecting portion can be caused to break off from the material of the remainder of the lid along said line of weakness and the projection caused to pivot with respect to the remainder of the lid about said living hinge, and wherein, furthermore, said remainder of the lid includes catch means capable of co-operating with a free end of the projection when the latter is so pivoted beyond a predetermined extent, to retain the projection in its pivoted position until forcefully displaced back towards its initial position.

Preferably, the lid has a generally planar rim and said base of said projecting portion, and in particular said living hinge, is further from said plane than said catch means, and wherein said catch means is afforded by a shoulder defined by a first wall portion meeting a top wall portion, said first wall portion having a lower edge nearer to said plane of said rim than is said top wall portion and said shoulder being nearer said projecting portion than said lower edge, said shoulder being so located and the lid structure being so resiliently flexible that, in the course of pivoting the projecting portion, about said living hinge, away from its initial position, the tip of said projecting portion can engage said top wall portion adjacent said shoulder and such that further pivoting forcefully in the same direction allows the tip of said projecting portion to be forced past said shoulder to be retained by engagement with said first wall portion.

The lid may, as with conventional disposable lids for the same purpose, be formed by a vacuum forming or similar process carried out on an initially flat, thin sheet of plastics material deformable or mouldable when sufficiently heated, and may thus have, as with conventional lids, a peripheral edge or rim lying substantially in a plane which is substantially that of the original sheet plastics material before moulding.

In manufacture of the preferred form of lid in accordance with the invention, by a vacuum forming or similar process, know per se, a large number of such lids is formed simultaneously from an initially flat thin sheet of thermoplastics material heated to a temperature at which it is plastically deformable, and which process displaces, out of the plane of the sheet, portions defining the top and a surrounding rim of each lid. The line of weakness around the base of said projecting portion may be formed at this stage by a punching operation or an operation in which a cut is made through only part, e.g., half, the thickness of the plastics material.

BRIEF DESCRIPTION OF THE DRAWINGS

Embodiments of the invention are described below by way of example with reference to the accompanying drawings, in which.

DETAILED DESCRIPTION OF THE PREFERRED EMBODIMENT

Figure 1:
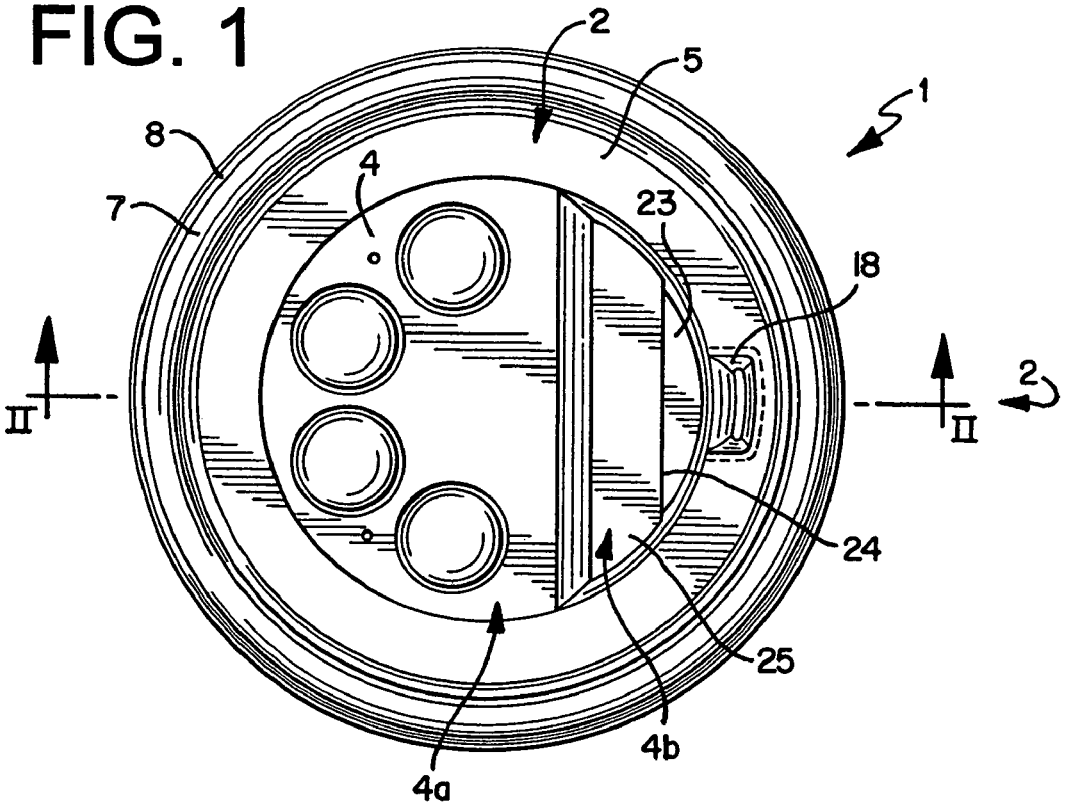
FIG. 1 is a plan view of a lid embodying the invention in an initial, closed condition.
Figure 2:
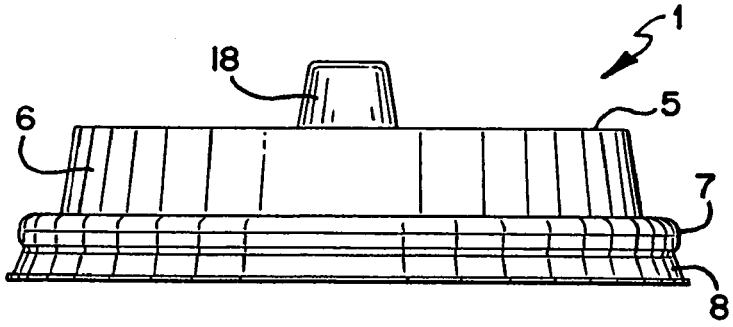
FIG. 2 is a side view looking in the direction of the arrow 2 in FIG. 1.

The lids shown in the drawings are made, as lids of this general sort commonly are, by subjecting a thin, initially flat, planar sheet of thermoplastics material to a forming process, such as a vacuum forming or pressing process, whilst it is at a temperature at which it is readily plastically deformable, the effect of the process being to displace some of the material of the sheet to predetermined extents out of the original plane of the sheet material. After such deformation, the plastics material is severed around the moulded regions which define the lids, to free the lids from the remainder of the sheet material. The plastics material used is of a resiliently flexible character at temperatures below its softening point or range.

The figures show a lid 1 having a circular body portion 2 which includes a central region 4, surrounded by an elevated, generally planar circumferential annular region 5 from which a projecting portion 18 is upstanding at one circumferential position on the lid. The circular annular region 5 is bounded, at its outer edge, by a circumferential wall 6, sloping downwards and outwardly from the edge of circular region 5 to a level below that of the central region 4. The lower edge of wall 6 merges with a region of arcuate vertical cross-section, which defines a resilient rib 7 which projects outwardly from the bottom of the wall 6. Extending from the base of the rib 7, on the side opposite the wall 6, is a generally frusto-conical, resilient skirt 8, defining a peripheral edge 9 lying in a plane which corresponds to the plane of the undeformed sheet material from which the lid was formed as described above. A major part 4*a* of the central region 4 surrounded by the elevated, generally planar circular annular region 5, is generally planar, but a segment, (in the geometrical sense), 4*a* of this central region is recessed below the plane of part 4, and significantly below the level of annual region 5 with the projecting portion 18 being disposed centrally with respect to the circular arc defined by this segment.

The projecting portion 18 has a base, in the plane of the annular planar region 5, which is approximately rectangular in plan (see FIG. 1), the projecting portion comprising a first side 17 which is effectively an upward continuation of the adjoining side wall of the segment-shaped recess 45, and an outer wall 19 which extends again upwardly and somewhat inwardly towards the central vertical axis of the lid to a rounded or blunt "point" 20 of the projection. The projection 18 further has two side walls extending upwardly and towards each other towards the free end or "point" 20 of the projection, whereby the projection 18 has a chisel-like configuration. In the initial state of the lid, three sides of a base of the projection 18 are defined by respective lines of weakening, for example formed by grooves or even interrupted slits in the plastics material of the planar annular region 5 adjacent, respectively, the lower end of the outer wall 19 and the lower ends of the two side walls. The remaining inner wall, 17 of the projection 18 is continuous with the adjacent wall of the segment-shaped recess except that a slight indentation 21, dividing the inner wall 17 of the projection 18 from the inner wall of the segmental recess 4*b* defines a localised region of high flexibility constituting a so-called "living hinge."

In use, a cup containing a beverage and fitted with the lid illustrate will be provided to a customer sealed at the point of sale—that is to say the projection 18 will be in its initial position shown in FIGS. 1 to 5 with the base of the projection 18 still attached to the adjoining part of the lid along all four sides of the projection. When the customer wishes to access the beverage he or she must apply a lateral force to the projection 18, for example by pushing it to the left in FIGS. 1, 3, 4 and 5 or by pinching the outer and inner walls (17, 19) of the projection 18 together, to rupture the weakened connection of the base of the projection 18 with the adjoining parts of the lid along the outer and side walls of the projection 18. Pivotal movement of the projection 18, thereafter, in an anticlockwise sense as viewed in FIGS. 5 and 6, causes the projection to execute a pivotal movement about the aforesaid living hinge 21.

Figure 3:
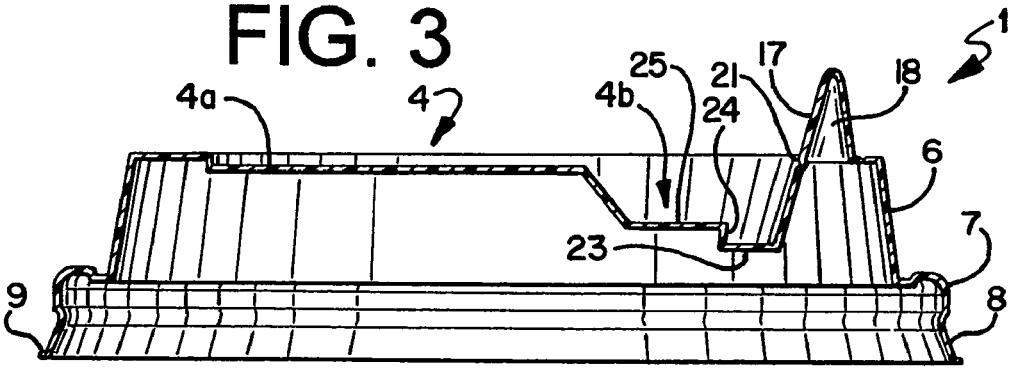
FIG. 3 is a view in section along the line II—II in FIG. 1.
Figure 4:
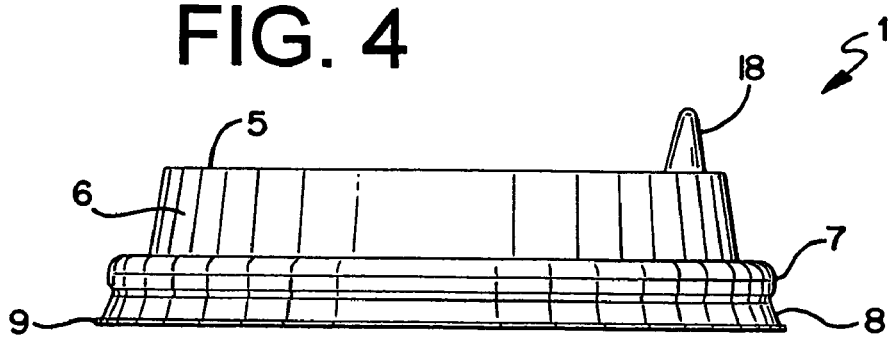
FIG. 4 is a corresponding side view.
Figure 5:
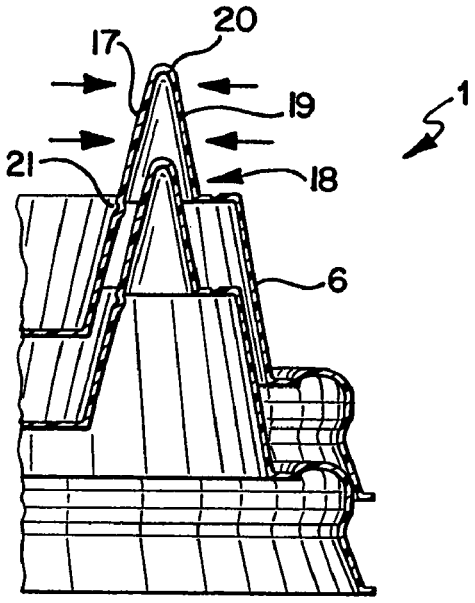
FIG. 5 is a fragmentary view in section along with line II—II of FIG. 1 to a larger scale.
Figure 6:
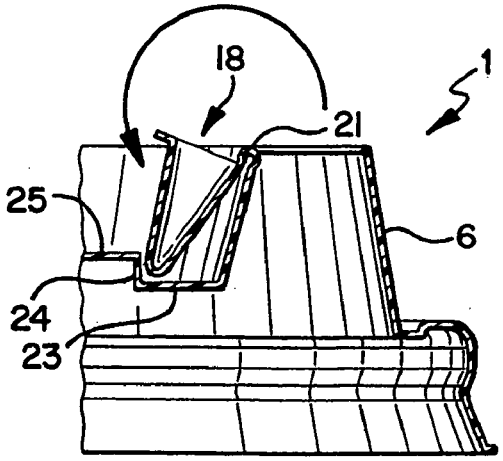
FIG. 6 is a corresponding view but showing the projecting portion separated from the remainder of the lid along the line of weakness and bent back on the living hinge to a retaining position.

Referring to FIGS. 1, 3 and 6, the recessed segment 4B has a lowermost portion 23 (i.e. a portion nearest the plane of the rim 9), which is parallel with the latter plane and extends to the bottom of the inner side wall of the recess 4B of which the wall 17 is an upward continuation. This portion 23 terminates, opposite the projection 18, in the lower edge of a first wall portion 24 which extends chordally as viewed in plan (FIG. 1) and which extends vertically upwardly from a lower edge, where it meets the portion 23, to a shoulder defined where the first wall portion 24 meets a top wall 25. (The top wall 25 nevertheless lies below the level of portion 4A and below the plane of annular recess 5) and thus below the plane of the base of projection 18. The location of the shoulder defined between the first wall portion 24 and the top wall portion 25 is such that, when the projection 18 is first pivoted anticlockwise as viewed in FIG. 6, away from its original position, the tip 20 of the projection 18 first strikes the top wall 25 closely adjacent the wall 24. However, the manual application of a slight additional force tending to pivot the projection 18 anticlockwise in FIG. 6 is sufficient to displace the relevant portions of the lid resiliently sufficiently to allow the tip 20 of the projection 18 to pass the shoulder defined between walls 24 and 25 into the recess defined above the lower horizontal wall portion 23. The projection 18 is thereafter retained in the last-mentioned position by engagement with the side wall 24 until and unless forced back manually to pass the shoulder defined between walls 24 and 25, (although there will normally be no useful purpose to be served by moving the projection 18 back out of its retained position illustrated in FIG. 6).

Figure 7:
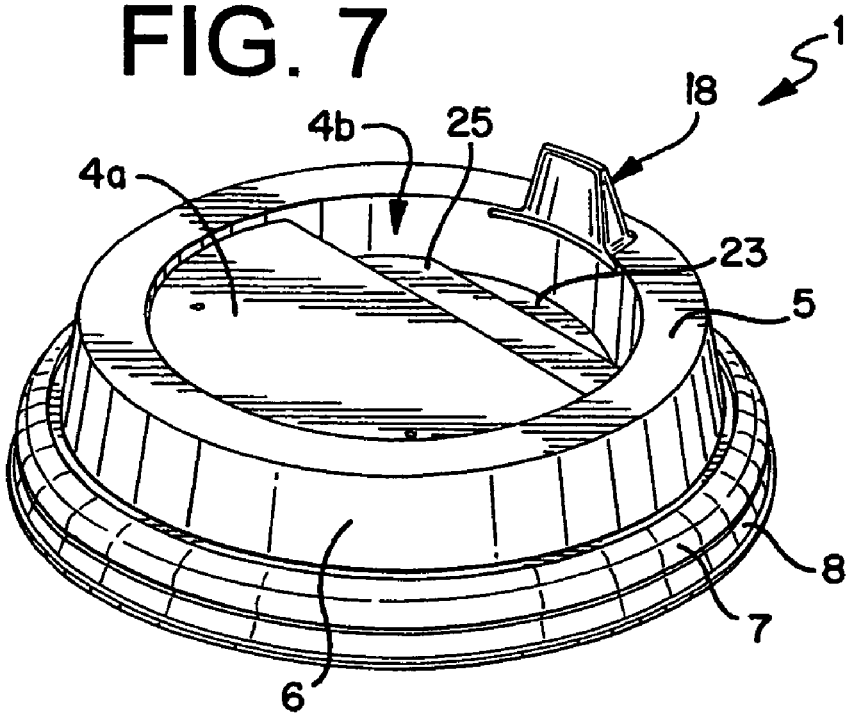
FIG. 7 is a perspective view of the lid with the projecting portion in its original, undisplaced position; and, FIG. 8 is a perspective view of the lid with the projecting portion bent back and retained in an open position.
Figure 8:
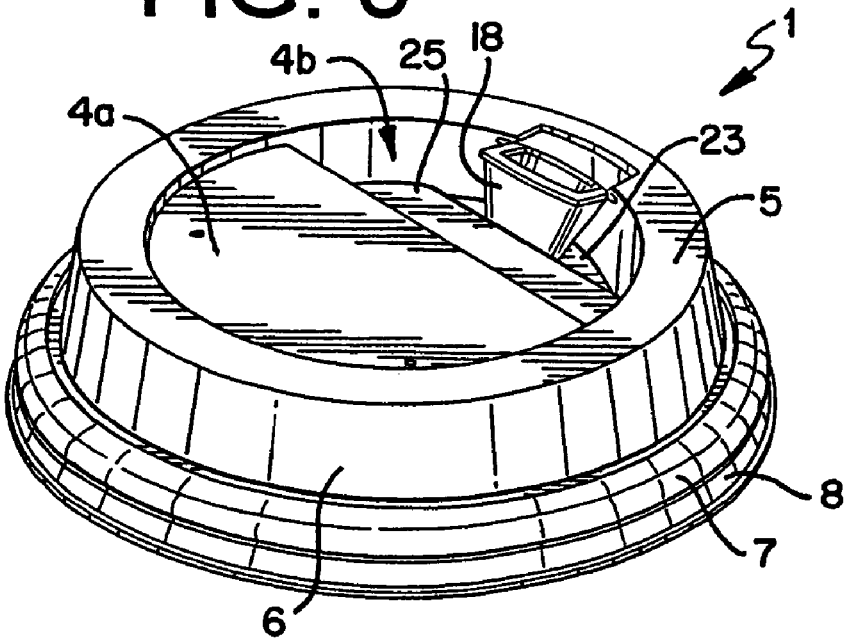

FIG. 7 and FIG. 8 are perspective views of the lid of FIGS. 1 to 6 showing the lid, respectively, in the original position, with the projection 18 projecting upwardly and (Figure A) showing the projection 18 in the position in which it has been folded back and is retained by the shoulder formed between wall 24 and to wall 25.

What is claimed is:

1. A lid for a container holding a flowable substance, the lid comprising:

a body having a mounting portion, a central portion defining an intermediate plane and a top wall defining an upper plane wherein the planes are misaligned, the top wall having a drink opening and an upwardly extending protrusion that is moveable about a hinge located adjacent an inner circular periphery of the top wall and at the base of the protrusion, the protrusion being moveable between a first position wherein the protrusion obstructs the drink opening, and a second position wherein the protrusion is received by the central portion.

2. The lid of claim 1 wherein the protrusion has an upper segment with an apex defined by a plurality of converging walls and wherein the apex is received by a recess of the central portion in the second position.

3. The lid of claim 2 wherein the recess has a deformable shoulder that engages the apex in the second position.

4. The lid of claim 3 wherein the deformable shoulder is defined by the junction of a generally horizontal wall and a generally vertical wall of the recess.

5. The lid of claim 1 wherein the protrusion has a lower segment with a rupturable seam positioned adjacent an outer periphery of the top wall.

6. The lid of claim 1 wherein the top wall has an annular configuration.

7. A lid for a container holding a flowable substance, the lid comprising:

a mounting portion configured to connect the lid to the container;

a sidewall extending upward from the mounting portion;

a top wall extending radially inward from the sidewall, the top wall residing in an upper plane and having both a drink opening and an upwardly extending protrusion, the protrusion moveably connected to the top wall by a hinge located proximate an inner periphery of the top wall;

and a central portion positioned radially inward of the top wall, the central portion having a primary horizontal wall positioned below the top wall, the central portion further having a recessed portion with a second horizontal wall positioned below the primary horizontal wall, the recessed portion having a receiver positioned below the second horizontal wall;

wherein the protrusion is moveable between a first position wherein the protrusion obstructs the drink opening, and a second position wherein an extent of the protrusion is removably received by the receiver.

8. The lid of claim 7, wherein the receiver is defined by a bottom horizontal wall positioned below the second horizontal wall and a substantially vertical transition wall positioned between the bottom and second horizontal walls.

9. The lid of claim 8, wherein an upper extent of the protrusion engages the vertical transition wall in the second position.

10. The lid of claim 7, wherein the protrusion has sloped walls that converge at an upper portion that is received by the receiver.

11. The lid of claim 7, wherein the protrusion has an apex defined by a plurality of sloped walls and wherein in the second position, the apex is received by the receiver.

12. The lid of claim 7, wherein the top wall has an outer circular periphery, and wherein the drink opening is positioned between the inner and outer peripheries.

13. The lid of claim 7 wherein the protrusion has a severable seam located at the base of the protrusion and opposite the hinge.

14. A lid for a container holding a flowable substance, the lid comprising:

a body having a mounting portion, a top wall residing in a horizontal plane above the mounting portion, a central portion located radially inward of the top wall and depending from the top wall, and a drink opening positioned entirely within the top wall, wherein the central portion has both a primary horizontal wall positioned below the top wall and a recessed portion with a second horizontal wall positioned below the primary horizontal wall, the recessed portion having a receiver positioned below the second horizontal wall;

the top wall having an upwardly extending protrusion, the protrusion having a hinge adjacent an interior edge of the top wall and a severable seam adjacent an exterior edge of the top wall;

wherein the protrusion is moveable between a first position wherein the protrusion obstructs the drink opening, and a second position wherein an extent of the protrusion is received by the receiver.

15. The lid of claim 14, wherein a base portion of the protrusion is cooperatively dimensioned with the drink opening.

16. The lid of claim 15, wherein the protrusion base has a flange that is cooperatively dimensioned with the drink opening.

17. The lid of claim 15, wherein the receiver is defined by a bottom horizontal wall positioned below the second horizontal wall and a substantially vertical transition wall positioned between the bottom and second horizontal walls, and wherein an upper extent of the protrusion engages one of the vertical transition wall and the second horizontal wall.

18. The lid of claim 14, wherein the protrusion has an apex defined by a plurality of converging walls and wherein in the second position, the apex is received in the central portion.

19. A lid for a container holding a flowable substance, the lid comprising:

a body having a mounting portion, a sidewall extending from the mounting portion, and a central portion positioned radially inward of the side wall, the central portion having a primary horizontal wall and a recessed portion, the recessed portion having a receiver and a secondary horizontal wall that is positioned below the primary horizontal wall, wherein the receiver is positioned below the secondary horizontal wall;

the body further having an upper wall positioned above the central portion, the upper wall having both a drink opening and an upwardly extending protrusion, the protrusion moveably connected to the top wall by a hinge located adjacent an inner periphery of the upper wall; and, wherein the protrusion is moveable between a first position wherein the protrusion obstructs the drink opening, and a second position wherein an extent of the protrusion is removably received by the receiver.

20. The lid of claim 19 wherein the protrusion has an apex defined by a plurality of converging walls, and wherein the apex is received by the receiver in the second position.

21. A lid for a container holding a flowable substance, the lid comprising:

a body having a mounting portion, a top wall residing in a horizontal plane above the mounting portion, a central portion located radially inward of the top wall and depending from the top wall, and a drink opening positioned entirely within the top wall;

the top wall having an upwardly extending protrusion, the protrusion having a hinge adjacent an interior edge of the top wall and a severable seam adjacent an exterior edge of the top wall, the protrusion further having an apex defined by a plurality of converging walls;

wherein the protrusion is moveable between a first position wherein the protrusion obstructs the drink opening, and a second position wherein the apex of the protrusion is removably secured in the central portion.

* * * * *